US008281422B2

(12) United States Patent
Chen et al.

(10) Patent No.: US 8,281,422 B2
(45) Date of Patent: Oct. 9, 2012

(54) HIDDEN SENSING DEVICE AND ITS URINAL

(75) Inventors: Zhongmin Chen, Shanghai (CN); Pengcheng Gao, Shanghai (CN); Lin Wang, Shanghai (CN); Jingwen Wu, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 560 days.

(21) Appl. No.: 12/576,551

(22) Filed: Oct. 9, 2009

(65) Prior Publication Data

US 2010/0088812 A1 Apr. 15, 2010

(30) Foreign Application Priority Data

Oct. 10, 2008 (CN) ..... 2008 1 0201044

(51) Int. Cl.
*E03D 13/00* (2006.01)

(52) U.S. Cl. ..... 4/305

(58) Field of Classification Search ..... 4/302–305, 4/313, 623
See application file for complete search history.

(56) References Cited

U.S. PATENT DOCUMENTS 4,918,762 A * 4/1990 Uhlmann ..... 4/303
6,662,382 B2 * 12/2003 Rump et al. ..... 4/304
8,185,977 B2 * 5/2012 Seibt ..... 4/431

* cited by examiner

*Primary Examiner* — Huyen Le
(74) *Attorney, Agent, or Firm* — Foley & Lardner LLP

(57) ABSTRACT

A hidden sensing device and its urinal are disclosed. The hidden sensing device, which is attached on some sanitary installations, comprises a conductivity sensor for detecting urine and a Micro-programmed Control Unit (MCU) for processing signals, wherein said conductivity sensor has electrodes extending into urine. The device further includes a microwave sensor controlled by the MCU to detect human's movements. When the conductivity sensor has detected urine, the MCU will turn on the microwave sensor to detect the human's presence or departure.

24 Claims, 4 Drawing Sheets

HIDDEN SENSING DEVICE AND ITS URINAL

FIELD OF THE INVENTION

The present invention relates to a hidden sensing device for flushing and sanitary installations with the hidden sensing device.

BACKGROUND OF THE INVENTION

For flushing urinals automatically after their use, conventional technology installs infrared sensors on urinals to detect the human being in front of the urinal. However the conventional infrared sensor has to put an inductive window on the exterior, which not only influences the appearance, but also causes the following shortcomings:

On the one hand, the conventional infrared sensor mostly uses active infrared sensing methods, which means that an infrared emitter emits infrared ray with certain lengths; the human being reflects the infrared ray; an infrared receiver receives the reflected infrared ray, evaluates the intensity of the reflection signals and finally decides the automatic detection. Nevertheless, there are some materials, such as clothing or hair with dark color, which have low reflectivity to infrared rays. They are not easily inducted automatically. Only a little infrared ray through these materials could be received by the infrared receiver. Weak reflection signals cause the inductor to fail to recognize objectives; accordingly, detection can not be triggered.

On the other hand, the way this conventional infrared inductor works is that once it detects a user over a certain period of time and then detects the departure, a certain amount of water comes out to flush the urinal. However, this would lead to a waste of resources because a certain amount of water always comes out regardless of whether the urinal is being used or not and regardless of the amount of urine.

Subsequently, conduction sensor technology came out, which can detect the change in conductivity of the water in the trap of the urinal. Based on the different conductivity of urine and tap water, once urine is coming, the electrode of the conduction sensor will touch the urine, and then the detected conductivity will change. Once the coming urine is detected, the urinal will flush.

Moreover, there is some technology wherein three electrodes are set in the trap of the urinal; and the timing to flush will be decided upon by detecting the distribution differences among these electrodes. When voltage among the electrodes balances at the end of urination (the balance from the beginning without any urine to the imbalance because of the urine, and back to the balance after even distribution of urine), the conductive sensor will think that the user has already stopped urinating and begin to flush. In contrast to the conventional infrared sensor, the conductive sensor doesn't have to create an inductive window; in addition, it corrected the flaw of the conventional sensor in which the detection to some materials with low reflectivity could fail.

However, in the event that the user is standing in front of the urinal for longer time due to prostatitis or other special conditions, the urinal with the conductive sensor will flush before the user departs. One side, it will bring inconvenience to users; the other side, the urinal could be suspected to be broken. Moreover, the time length for flushing has to be set up manually. The urinal can not give water amount automatically according to the amount of urine.

To resolve the shortcoming of the conductive sensor, a urinal based on the technology of microwave sensor appeared. It applies Fourier operation to the microwave sensing signals to get the frequency spectrum of the human being and his urine; it then decides the length of the urine and if the user still there or not. Finally, the urinal will control the timing of the flush and the amount of water.

However, the Fourier operation consumes too much energy for battery No. 5 or No. 7 to meet its power requirement. In this case, AC is necessary to be used. Therefore, the urinal with microwave sensor does not fit the environmental philosophy about energy-saving; in addition, the limitation of AC made it inconvenient to install the urinal and accordingly incumber its application.

Nowadays, the top priority for the people in the art is to develop a more energy-saving and practical sensing device and corresponding urinal.

SUMMARY OF THE INVENTION

The present invention generally provides a hidden sensing device and its corresponding urinal.

In one aspect, the present invention provides a hidden sensing device installed on a urinal (suggest "a sanitary installation") comprising a conduction sensor for detecting urine and a MCU for processing signals, wherein the conduction sensor has electrodes extending into the urinal to touch the urine. The hidden sensing device further comprises a microwave sensor controlled by the MCU for detecting the movement of the human being. As soon as the conduction sensor detects urine, the MCU turns on the microwave sensor to detect the presence or departure of the human being.

Moreover, said electrodes can be bipolar; said conduction sensor could decide the existence of the urine by detecting electric conductivity.

Moreover, a predetermined electric conductivity value can be set in advance. When an actual electric conductivity is higher than the predetermined value, it is regarded that there is urine.

Moreover, the concentration of urine obtained by electric conductivity can be converted to the amount of water flushed. By doing that, the hidden sensing device becomes more intelligent and is beneficial to water-saving.

Moreover, the relationship between concentration of urine and electric conductivity is: $A=aL^2+bL$, wherein A stands for concentration of urine; L is electric conductivity; a and b are coefficient.

Moreover, once the conduction sensor detects the balance of urine, it will inform the MCU to turn on the microwave processor to detect the human being. By this setup, sensing effect will be more reliable, comfortable, and less mistakes will occur.

Moreover, a certain electric conductivity can be predetermined. When the sampled conductivity of the urine of N number of consecutive points is less than the predetermined value, the balance is judged.

Moreover, the conduction sensor has lower detection frequency under the condition without urine than under the condition with urine, so this benefits energy saving.

Moreover, the conduction sensor has the function of self learning.

Moreover, the microwave sensor includes a gain amplification circuit to adjust sensing distance and sensing range.

In another aspect, the present invention also provides a urinal comprising a hidden sensing device, batteries for furnishing power, and an electromagnetic value for controlling water discharge, wherein said hidden sensing device comprises an MCU for processing signals, a microwave sensor controlled by the MCU for detecting the presence of the human being, and a conduction sensor for detecting urine.

The electrodes of said conduction sensor are disposed under the liquid level of the siphon of the urinal. The microwave sensor is installed at the back of the ceramic parts of the urinal. When the conduction sensor has detected urine, the microwave sensor begins to work, and then informs the MCU to open the electromagnetic valve to flush once having detected the departure of the human being.

Moreover, said electrodes can be bipolar so that urine can be identified by conductivity.

Moreover, a predetermined electric conductivity value can be set. When an actual electric conductivity is higher than the predetermined value, it is identified that there is urine.

Moreover, the concentration of urine obtained by electric conductivity can be converted to the amount of flush water. By doing that, the hidden sensing device becomes more intelligent and is beneficial to water-saving.

Moreover, the relation between concentration of urine and electric conductivity is: $A=aL^2+bL$, wherein A stands for concentration of urine; L is electric conductivity; a and b are coefficient.

Moreover, once the conduction sensor detects the balance of urine, it will inform the MCU to turn on the microwave sensor to detect human being. By the setup, sensing effect will be more reliable, comfortable and less mistakes will occur.

Moreover, a certain electric conductivity can be predetermined in advance. When N numbers of consecutive samplings of the conductivity of urine is less than the predetermined value, balance is judged.

Moreover, the conduction sensor has lower detection frequency under the situation without urine compared with the situation with urine so that benefit energy saving.

Moreover, the two electrodes are installed at the same level.

Moreover, the conduction sensor has the function of self learning.

Moreover, the microwave sensor includes a gain amplification circuit to adjust sensing distance and sensing range.

For a further understanding of the nature and advantages of the present invention, reference should be made to the following description taken in conjunction with the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the following detailed description of the embodiments, reference is made to the accompanying drawings which form a part hereof, and in which is shown by way of illustration specific embodiments in which the disclosure may be practiced. These embodiments are described in sufficient detail to enable those skilled in the art to practice the invention, and it is to be understood that other embodiments may be utilized and that structural, logical and electrical changes may be made without departing from the spirit and scope of the disclosures. The following detailed descriptions are, therefore, not to be taken in a limiting detection, and the scope of the disclosure is defined only by the appended claims.

Figure 1:
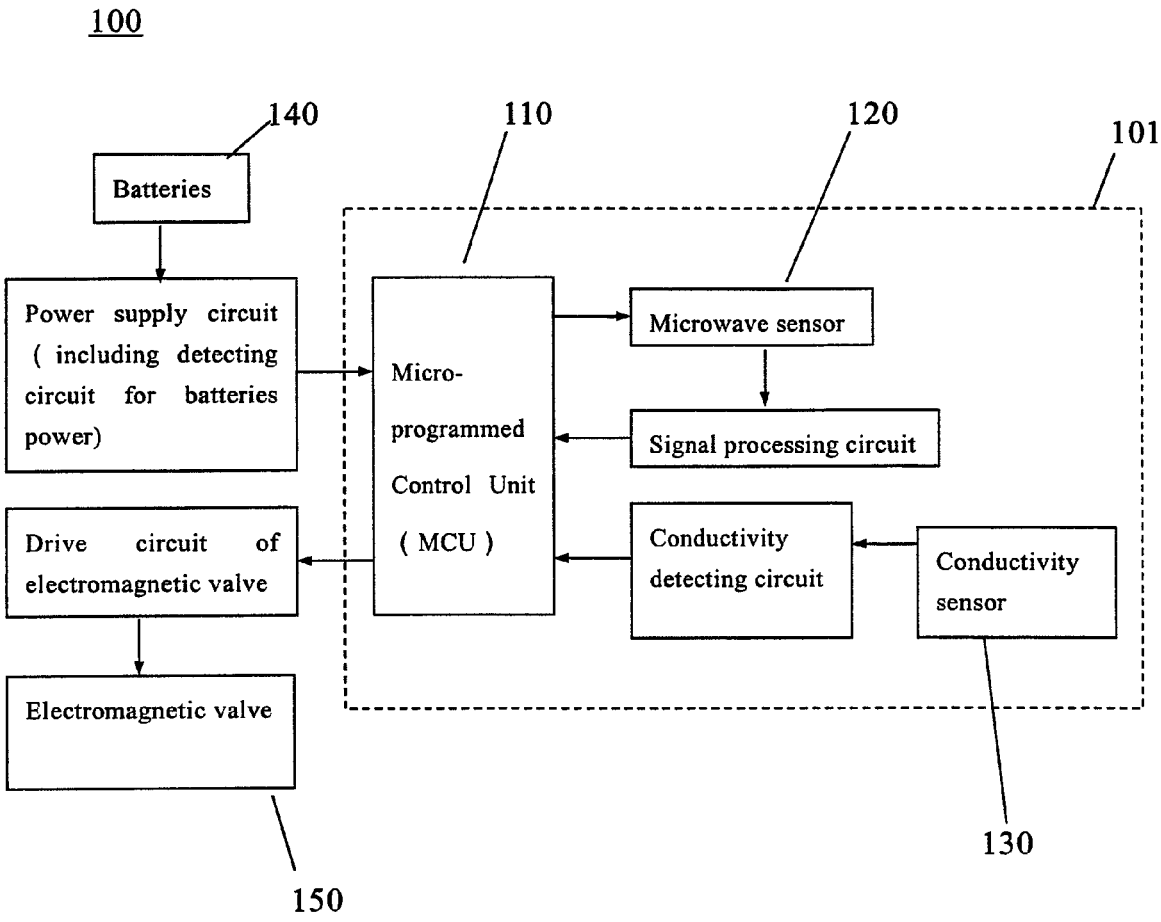
FIG. 1 is a schematic diagram of a hidden sensing device and its urinal.

FIG. 1 illustrates a hidden sensing device 101 which comprises a Micro-programmed control unit (MCU) 110, a microwave sensor 120 for detecting human being's movements and a conductivity sensor 130 for detecting urine, wherein the microwave sensor 120 can detect human being or the movement of some objects. As soon as the conductivity sensor 130 has detected urine, the MCU 110 is informed to turn on the microwave sensor 120. Furthermore, if the microwave sensor has detected the movement of the human being or objects, the MCU 110 will be informed of the detected results. The next, the MCU 110 will control some executive agency of the corresponding urinal. In the present invention, the urinal 100 comprises a hidden sensing device 101, batteries 140 for supplying electricity and an electromagnetic valve 150.

In one embodiment of the disclosure, batteries 140 supplies electricity to the hidden sensing device 101 of the urinal 100. The MCU 110 controls the drive circuit of the electromagnetic valve 150 to open and close the valve 150, and accordingly to control the flush. The electrodes of said conductivity sensor 130 detect urine, and corresponding detected results are informed to the MCU 110 through conductivity detecting circuit. Having identified urine, the MCU 110 turns on microwave sensor 120. Once the microwave sensor has detected the presence or departure of the user in front of the urinal 100, it will inform the MCU 110 through signal processing circuit. When the MCU 110 determines the departure of the user, it further controls the electromagnetic valve to open or close through the control circuit of the valve in order to control the flushing of the urinal 100 or other sanitary installations.

The hidden sensing device 101 can be applied to sanitary installations other than the urinal if connected with other executive mechanisms. For example, connected with the cover board of a toilet, the MCU 110 can control the cover board to close automatically once the microwave sensor has detected the departure of users.

Moreover, the power circuit of the urinal 100 includes a battery power detecting circuit. When the voltage of the battery is less than a certain value, the battery will not be used any more and should be replaced with a new one. The notification could be short or long beep.

Microwave sensor 120 can be adjusted to detect different sensing distance and sensing angle range. Take the urinal 100 as an example; in an embodiment the adjustable sensing distance is from 20 cm to 75 cm. In another embodiment, the range is 15 cm~70 cm. In another embodiment, adjustable distance is between 25 cm~80 cm. Generally, the reasonable and ideal adjustable distance is from 20 cm+/−5 cm to 75+/−5 cm. As for the sensing angle range, in one embodiment, the horizontal angle is 25° and the vertical angle is 35°. Generally, the ideal angle range is 25+/−5° at horizontal and 35+/−5° at vertical. The adjustable distance and angle are not limited to the range described above. They could be adjusted according to the actual environment.

Said microwave sensor 120 has a gain amplification circuit for adjusting sensing distance and angle. By reducing the gain amplification of microwave signals, the detecting distance and angle are reduced. By doing so, some inconveniences can be avoided; for example, opening and closing the door for a bathroom, or moving other objects in the bathroom. As a result, this reinforces the practicability and reliability of microwave sensor.

Figure 2:
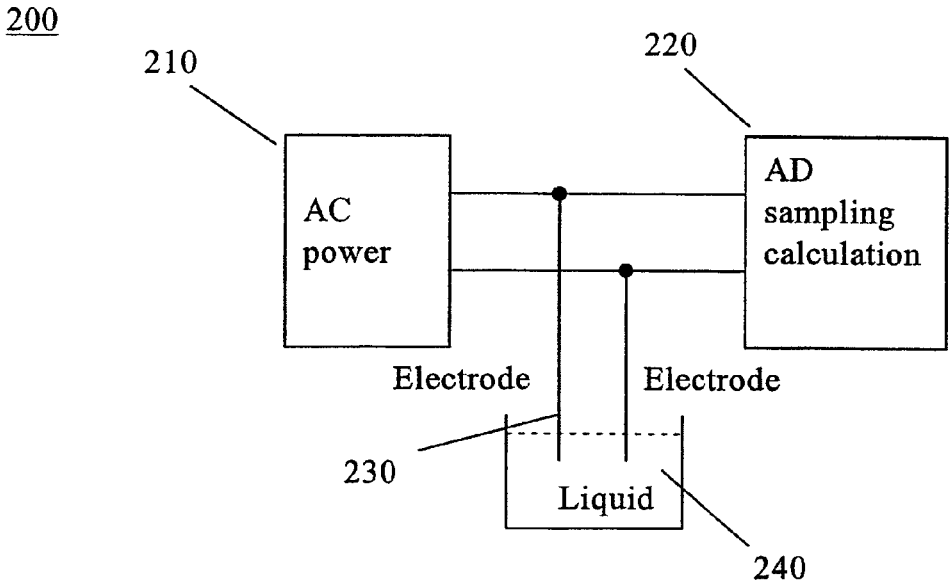
FIG. 2 is a schematic diagram of a conductivity sensor in the hidden sensing device.
Figure 3:
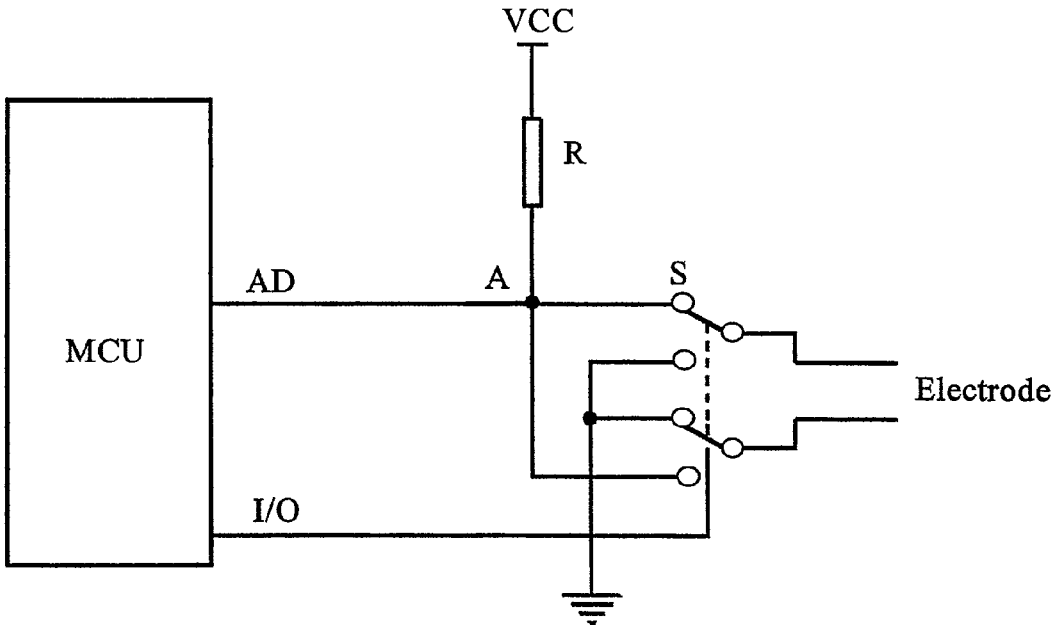
FIG. 3 is a circuit diagram of the AC of the conductivity sensor.

As shown in FIG. 2 and FIG. 3, said conductivity sensor 200 has two electrodes 230 which are extending under the liquid level. Based on the different conductivity of tap water and urine, the conductivity sensor can detect different urine concentrations and thereby decide to flush or not.

Moreover, the conductivity sensor 200 can convert the conductivity of urine into the concentration by virtue of the relationship between conductivity and concentration of urine and further converts into the amount of water flushed. By doing so, the amount of water flushed can intelligently depend on the amount of urine. Specifically, the more urine concentration is, the higher conductivity is. The basic formula is $A=aL^2+bL$, wherein A is urine concentration, L is conductivity, a and b is coefficient. After flushing, conductivity sensor 200 can further detect concentration and flushing effects. Consequently, the conductivity sensor of the present invention can distinguish the urine proportion in water, thereby identify the flushing amount according to urine concentration and detect the concentration of mixed liquid after flushing to implement the closed loop control of the amount of water flushed. As for the relationship of urine concentration and the amount of flushing, it can be obtained through practical tests and the structure of sanitary installations to make detection more intelligent and water-saving.

As shown in FIG. 3, also, the conductivity sensor has a circuit which prevents electrodes from polarization. The electric principle is as follows: AC power is used to prevent the polarization of electrodes; two sets of double throw switches are used to switch the polarity of electrodes to prevent polarization. The switch could be analog switch. By changing the polarity of electrodes, some problems, such as dropping electric conduction or even failure conduction, which come from the polarization of electrodes, can be resolved.

As shown in FIG. 3, the MCU samples the voltage between two electrodes "A", calculates the conductivity of detected liquid through DAC operation, and then gets the concentration of the urine. FIG. 3 is just one embodiment of the present invention. There are many methods can be used for sampling voltage of electrodes. The relationship of voltage sampling value and conductivity depends on different circuit layouts; so the formula is not limited to one. Simply speaking, the lower the voltage sampling value is, the higher the conductivity is; and vice versa.

Figure 4:
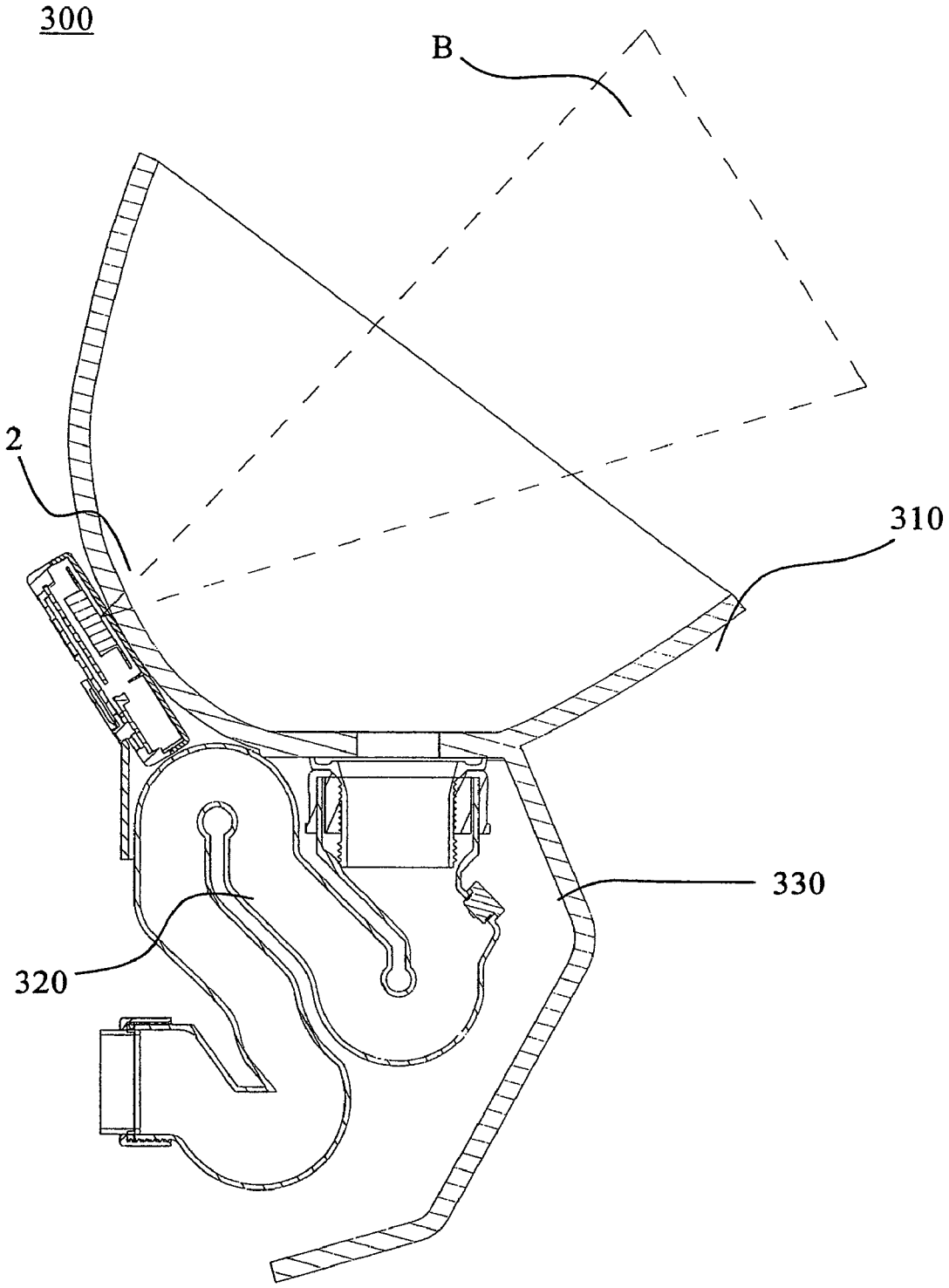
FIG. 4 is a structural diagram of a urinal installed on the hidden sensing device.

FIG. 4 is a structural diagram of embodiment of a urinal with the hidden sensing device of the present invention. A conductivity sensor 330 is attached to a siphon 320 which is under the urinal itself 310. The installation place makes the urine induct fast and prevents waste particles from easily building up on the face of the electrodes. The electrodes should be put under the liquid level with a certain depth. In one embodiment of the present invention, the depth is 6 mm. Generally, it is better more than 5 mm.

For better detecting effects, it is better for microwave sensor 120 to be attached on the back of the urinal 310 in order to cling to the inner wall of the urinal. The ideal installation place is that it can detect the buttocks area of human body, such as the B area shown in FIG. 4 which indicates the microwave detecting area. In addition, to insure the detecting areas to cover the buttocks area of users, other factors should also be considered, such as the installation requirement, different statures and its proportion statistics of different countries, and the consumer habit, etc.

Figure 5:
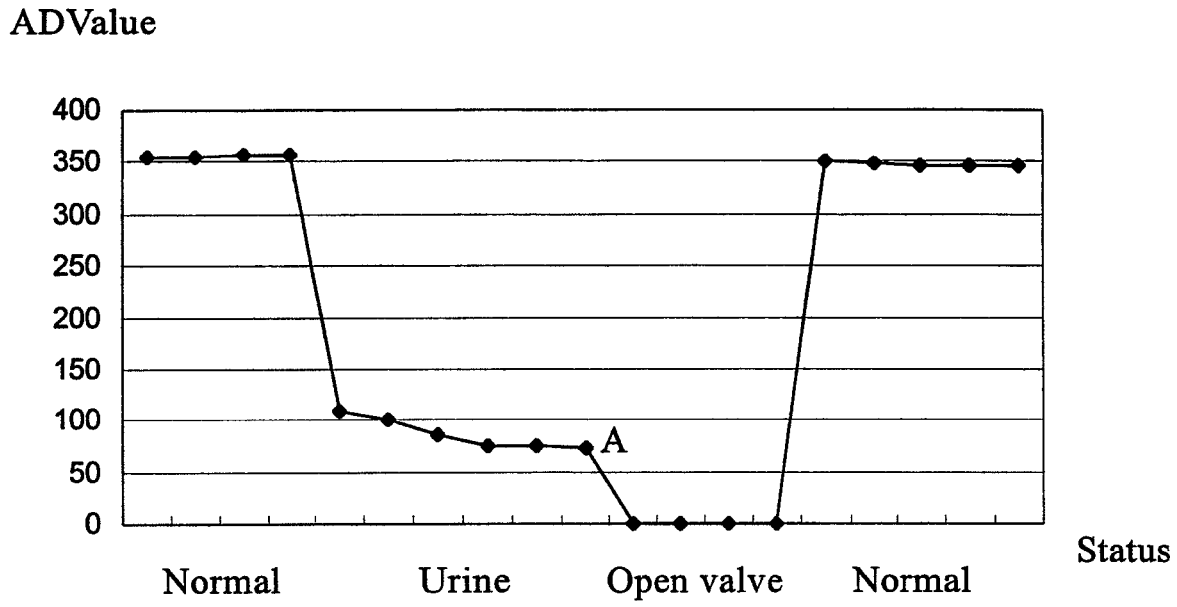
FIG. 5 is diagram showing the working status of the hidden sensing device.

FIG. 5 is the working status diagram of the urinal in practice, which is based on the voltage sampling value of point "A" which is shown in FIG. 3. We can tell from the diagram:

When there is no urine, the voltage sampling value of point A keeps a standard value, the voltage sampling value of pure tap water.

When urine comes, the conductivity sensor can detect it and the voltage sampling value of point A will drop rapidly which also means higher conductivity. A predetermined value of the voltage sampling value should be set. When the voltage sampling value of point A is lower than the predetermined value, the MCU will judge it as a presence of urine.

When the voltage sampling value of point A keeps stable, the MCU will judge that the urine is done. The method for judging balance is called N points-balance method wherein N is not less than 2. In one embodiment of the present invention, 3 points are used to determine if the urine is finished or not, namely, when three consecutive detected voltages sampling value of point A keep the same or similar value, it is regarded that the value goes to balance. As shown in FIG. 5, A is balanced value because the difference between the voltage sampling value of point A and the two points before point A is less than a certain value. In one embodiment of the present invention, when the difference value among the three points is not more than 5, then the three points are regarded as balanced. Alternatively, the value of variation can be adjusted according to the place of electrodes or different detecting environment. In another embodiment of the present invention, when the value of variation of three points is not more than 10, a balance is judged.

When the voltage sampling value of point A goes to balance, the MCU will turn on microwave sensor 2. When no human body or objects detected by the microwave 2, the MCU will control electromagnetic valve 5 to flush. As stated above, the amount of flushing is based on the concentration of urine so that the urinal 100 is getting more intelligent. In another embodiment of the present invention no urine concentration is used to decide the amount of flushing; instead, just flush a certain amount of water.

After flushing, conductivity 3 will detect that the voltage sampling value of point A comes back to the normal value.

The judgment described above is based on the voltage sampling value of point A. Also, conductivity can be based on directly. To judge urine, a conductivity value should be predetermined. When detected conductivity is higher than the predetermined value, the urine is judged. For the further judgment of balance, certain conductivity should be set firstly. When the variation of sampled urine conductivity of N number of consecutive points (N is not less than 2) is less than the certain value, it is judged as balanced. Actually, the voltage sampling value of point A is just reflecting the conductivity.

The voltage of point A is just the reflection of the voltage of two electrodes. Because the voltage sampling value of point A would be different with different circuits, the embodiment shown in FIG. 3 is just one alternative. Therefore, any methods using numerical value related to conductivity as the base of measure or judgment will go to the scope of the present invention.

It is true that another embodiment of the present invention does not use the balance of three points to analyze; instead, it uses two points or four points. That way, sensing effects will be more reliable, comfortable and can prevent incorrect manipulation. The easier way is not using balance method, namely, once conductivity sensor 130 has judged the existence of urine, microwave sensor 120 is turned on to detect users' presence or departure and then execute the subsequent operations.

For reducing more energy expenditure, the conductivity sensor has different detecting period for the condition with urine and without urine. The detecting period for condition without urine is longer than that with urine. In one optimally selected embodiment, the detecting period for the status without urine is 5 seconds while one second for the status with urine. In another optimally selected embodiment, the detecting period for status without urine is 6 seconds while 2 seconds for the status with urine.

The conductivity sensor 130 has the function of self-learning. Every time when getting power or right after cleaning the urinal, the conductivity sensor 130 starts self-learning in order to obtain the conductivity of pure tap water in the present situation.

By doing so, some problems, which include different conductivity of tap water in different areas or during different times, deriving from the uniform standard of tap water, which is set before leaving factories, can be prevented Because the power consumption of conductivity sensor 130 is less, detecting urine through the conductivity sensor can save energy. Moreover, because the detecting frequency in the condition without urine is lower than that with urine, the power consumption can be much less. In contrast with conductivity sensor, the microwave sensor 120 has higher power consumption and the microwave sensor works only the conductivity sensor 130 has detected urine. Therefore, the microwave sensor 120 does not have to be on often. As a result, power consumption is getting lower. The present invention combines microwave sensor 120 and conductivity sensor 130 to come to a more reliable, low power consumption technology.

Moreover, the microwave sensor in the present invention can be combined with other conductivity sensors (e.g. triple electrodes) disclosed in prior arts. The microwave sensor can also be installed at other place that is nearby the sanitary installations and convenient to detect users' movements.

The present subject matter may be embodied in other specific forms without departing from the spirit or essential characteristics thereof. The embodiments are therefore to be considered in all respects as illustrative and not restrictive, the scope of embodiments of the subject matter being indicated by the appended claims rather than by the foregoing description, and all changes which come within the meaning and range of equivalency of the claims are therefore intended to be embraced therein.

What is claimed is:

1. A hidden sensing device, which is attached on a sanitary installation, comprising:

a conductivity sensor for detecting urine, which has electrodes extending into said sanitary installation in order to touch urine;

an MCU for processing signals; and a microwave sensor controlled by said MCU for detecting human's movements;

when said conductivity sensor has detected urine, the MCU will turn on said microwave sensor to detect human's presence or departure.

2. The hidden sensing device according to claim 1, wherein said electrodes are double-electrodes; said conductivity sensor detects conductivity and judges whether there is urine or not.

3. The hidden sensing device according to claim 2, wherein a conductivity value is predetermined in advance; when actual conductivity value is higher than said predetermined value, it is concluded there is urine.

4. The hidden sensing device according to claim 3, wherein said conductivity is used to calculate urine concentration, and then converted into the amount of water flushed.

5. The hidden sensing device according to claim 4, wherein said urine concentration has the following relationship with said conductivity:

$A=aL^2+bL$;

said A is urine concentration;

said L is conductivity;

a and b are coefficient.

6. The hidden sensing device according to claim 2, 3, 4 or 5, wherein once having detected the balance of the conductivity of urine, said conductivity sensor informs said MCU to turn on said microwave sensor to detect human body.

7. The hidden sensing device according to claim 6, wherein a constant conductivity value is predetermined in advance; when the variation value of sampled urine conductivity of consecutive N number of points is less than said constant value, it is concluded that it is balanced; said N is not less than 2.

8. The hidden sensing device according to claim 1, wherein said conductivity sensor sets lower detecting frequency for the condition without urine than for the condition with urine.

9. The hidden sensing device according to claim 1, wherein said conductivity sensor has the function of self-learning.

10. The hidden sensing device according to claim 1, wherein said microwave sensor has a gain amplification circuit for adjusting sensing distance and range.

11. A urinal comprising:

a hidden sensing device;

batteries for supplying electricity; and an electromagnetic valve for controlling flushing;

wherein said sensing device comprise an MCU for processing signals;

a microwave sensor controlled by said MCU for detecting human's presence and departure; and a conductivity sensor for detecting urine;

electrodes of said conductivity sensor are installed under the liquid level of the siphon of the urinal;

said microwave sensor is installed on the back of the ceramic parts of the urinal;

once said conductivity sensor has detected urine, said microwave sensor is turned on by said MCU; after having detected the departure of human said microwave sensor informs said MCU to open said electromagnetic valve to flush.

12. The urinal according to claim 11, wherein said electrodes are double-electrodes which detect conductivity and judges whether there is urine or not.

13. The urinal according to claim 12, wherein a conductivity value is predetermined in advance; when actual detected conductivity is higher than said predetermined value, it is concluded there is urine.

14. The urinal according to claim 13, wherein said conductivity is used to calculate urine concentration and then converted into the amount of water flushed.

15. The urinal according to claim 14, wherein said urine concentration has the following relationship with said conductivity:

$A=aL^2+bL$;

said A is urine concentration;

said L is conductivity;

a and b are coefficient.

16. The urinal according to claim 15, wherein once said having detected that the conductivity of urine is balanced, said conductivity sensor informs said MCU to turn on said microwave sensor to detect human body.

17. The urinal according to claim 16, wherein a constant conductivity value is predetermined in advance; when the variation value of sampled urine conductivity of consecutive N numbers of points is less than said constant value, it is concluded that it is balanced; said N is not less than 2.

18. The urinal according to claim 17, wherein said conductivity sensor sets lower detecting frequency for the condition without urine than for the condition with urine.

19. The urinal according to claim 11, wherein said two electrodes are located at the same level.

20. The urinal according to claim 11, wherein said conductivity sensor has the function of self-learning.

21. The urinal according to claim 11, wherein said microwave sensor has a gain amplification circuit for adjusting sensing distance and range.

22. A urinal comprising:

a hidden sensing device; and an electromagnetic valve for controlling flushing;

said sensing device comprise an MCU for processing signals;

a microwave sensor controlled by said MCU for detecting human's presence and departure; and a conductivity sensor for detecting urine;

electrodes of said conductivity sensor are installed under the liquid level of the siphon of the urinal;

said conductivity sensor informs said MCU to turn on said microwave sensor by detecting conductivity and judging if there is urine;

said microwave sensor is installed on or around the urinal as long as it is beneficial to detecting human's movements;

having detected the human's departure, said microwave sensor informs the MCU to open said electromagnetic valve to flush.

23. The urinal according to claim 22, wherein according to detected variation value of conductivity by said electrodes, said conductivity sensor judges whether there is urine or not.

24. The urinal according to claim 23, wherein having detected that the conductivity of urine is balanced, said conductivity sensor informs said MCU to turn on said microwave sensor to detect the human body.

* * * * *